US009744637B1

(12) United States Patent
Lawhon

(10) Patent No.: US 9,744,637 B1
(45) Date of Patent: Aug. 29, 2017

(54) FLOOR PROCESSING SYSTEM

(71) Applicant: Charles Lawhon, Tolar, TX (US)

(72) Inventor: Charles Lawhon, Tolar, TX (US)

( * ) Notice: Subject to any disclaimer, the term of this patent is extended or adjusted under 35 U.S.C. 154(b) by 81 days.

(21) Appl. No.: 15/057,987

(22) Filed: Mar. 1, 2016

Related U.S. Application Data

(60) Provisional application No. 62/126,676, filed on Mar. 1, 2015.

(51) Int. Cl.
*B24B 7/18* (2006.01)
*B28D 1/20* (2006.01)

(52) U.S. Cl.
CPC ..... *B24B 7/186* (2013.01); *B28D 1/20* (2013.01)

(58) Field of Classification Search
CPC ..... A47L 11/16; B24B 7/182; B24B 7/186; B24B 23/02; B28D 1/20
See application file for complete search history.

(56) References Cited

U.S. PATENT DOCUMENTS 1,832,267 A * 11/1931 Toffolo ..... B24B 7/186 15/49.1
4,136,491 A * 1/1979 Redifer ..... B24B 7/186 15/49.1
4,319,434 A * 3/1982 Brejcha ..... B24B 41/047 15/49.1
4,709,510 A * 12/1987 Giovanni ..... A47L 11/02 15/98
4,719,659 A * 1/1988 Urakami ..... A47L 11/16 15/49.1
4,862,548 A * 9/1989 Sergio ..... A47L 11/16 15/49.1
5,742,966 A * 4/1998 Tono ..... A47L 11/305 15/49.1
5,762,545 A * 6/1998 Edwards ..... B24D 13/142 451/353
5,863,241 A * 1/1999 Rottschy ..... B24B 41/047 451/271
7,140,957 B2 * 11/2006 Thysell ..... B24B 7/186 451/350
7,377,838 B1 * 5/2008 Van Vliet ..... A47L 11/16 15/49.1
8,715,039 B2 * 5/2014 Chen ..... B24B 23/028 451/350
2014/0154959 A1 * 6/2014 Van Der Veen ..... B24B 7/18 451/350
2017/0043445 A1 * 2/2017 Lilienberg ..... B24B 27/0007

* cited by examiner

*Primary Examiner* — Timothy V Eley
(74) *Attorney, Agent, or Firm* — Eldredge Law Firm; Richard G. Eldredge

(57) ABSTRACT

A floor processing system for a skid steer loader includes a shroud having an attachment device configured to removably engage with the skid steer loader; a central motor secured to the shroud and rotatably attached to an arm; a first rotary assembly secured to the arm; and a second rotary assembly secured to the arm. The first rotary assembly includes a first disc rotatably attached to a first motor via a first shaft; and a plurality of first cutters extending from the first disc. The second rotary assembly secured to the arm includes a second disc rotatably attached to a second motor via a second shaft; and a plurality of second cutters extending from the second disc.

1 Claim, 5 Drawing Sheets

FLOOR PROCESSING SYSTEM

BACKGROUND

1. Field of the Invention

The present invention relates generally to equipment used to flatten and polish concrete floors, most commonly referred to as grinders, and more specifically, to a floor processing system.

2. Description of Related Art

Floor processing systems, commonly referred to as floor grinders or polishers are widely used to perform work on floors. Some examples of such work include grinding, flattening (planning), and polishing. Concrete grinders are available in many configurations. One configuration includes purpose-built floor grinders that are used for grinding and polishing marble, granite, and concrete. All concrete grinders use some sort of abrasive to grind or polish such as diamond tools or Silicon carbide. The cutting tools used for grinding most commonly are diamond grinding cup wheels, and for polishing are usually diamond polishing pads.

Conventional floor grinders include a round disk which contains a radial array of cutting disks which is rotationally driven by an onboard motor. Conventional floor grinders are made to be manually maneuvered by a person pushing it from behind as shown in FIG. 1. Conventional floor grinders' cutting wheels are limited in size due to their "push-behind" design which is viewed as a disadvantage. This downfall reduces the amount of useable cutting area of the system. Since conventional floor grinders are relatively small in size, they are notoriously labor intensive and inefficient. This is viewed as another common problem with conventional floor grinders. This disadvantage proves that many labor hours are needed to grind/polish a large area.

Although great strides have been made in the area of floor processing systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
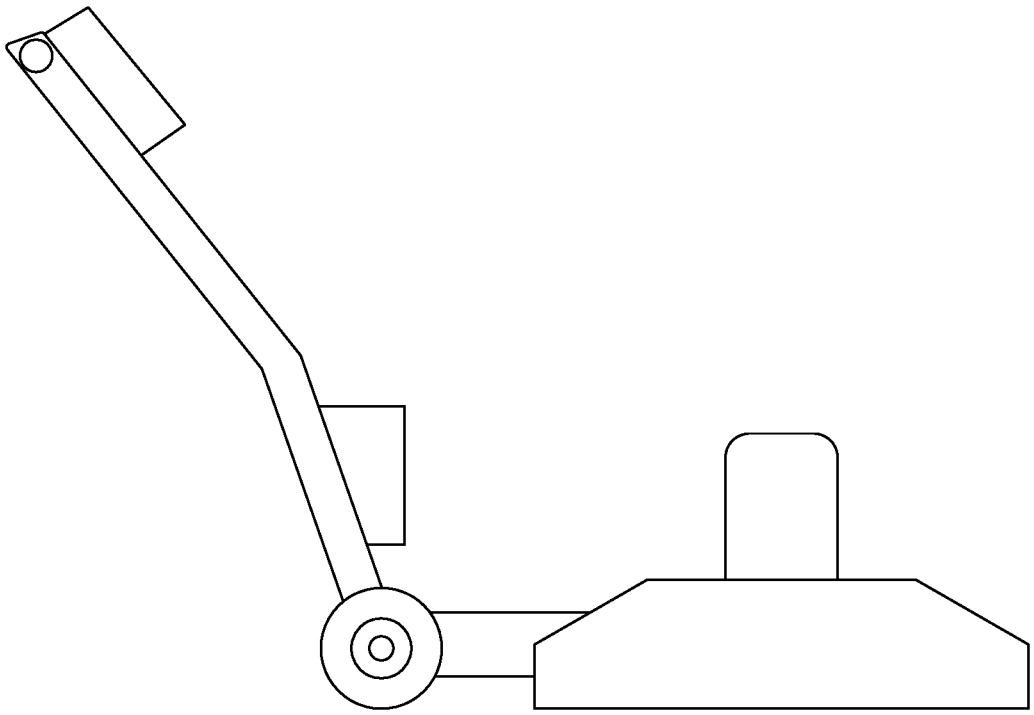
FIG. 1 (PRIOR ART)
FIG. 1 is a front view of a conventional floor processing system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with floor processing systems. Specifically, the system of the present application includes a motor driven, grinding wheel assembly which attaches to the end of a rotating beam which is also motor driven. The rotating beam moves the grinding wheel assembly in a circular motion providing for a large polishing area during operation. This is viewed as an advantage of the system of the present application. Additionally, the system polishes and flattens the floor more effectively due to the wide sweeping, circular motion of the beams rotation. This is viewed as another advantage of the system of the present application. These and other unique features of the floor processing system and method of use are discussed below and illustrated in the accompanying drawings.

The system and method of use will be understood, both as to its structure and operation, from the accompanying drawings, taken in conjunction with the accompanying description. Several embodiments of the floor processing system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
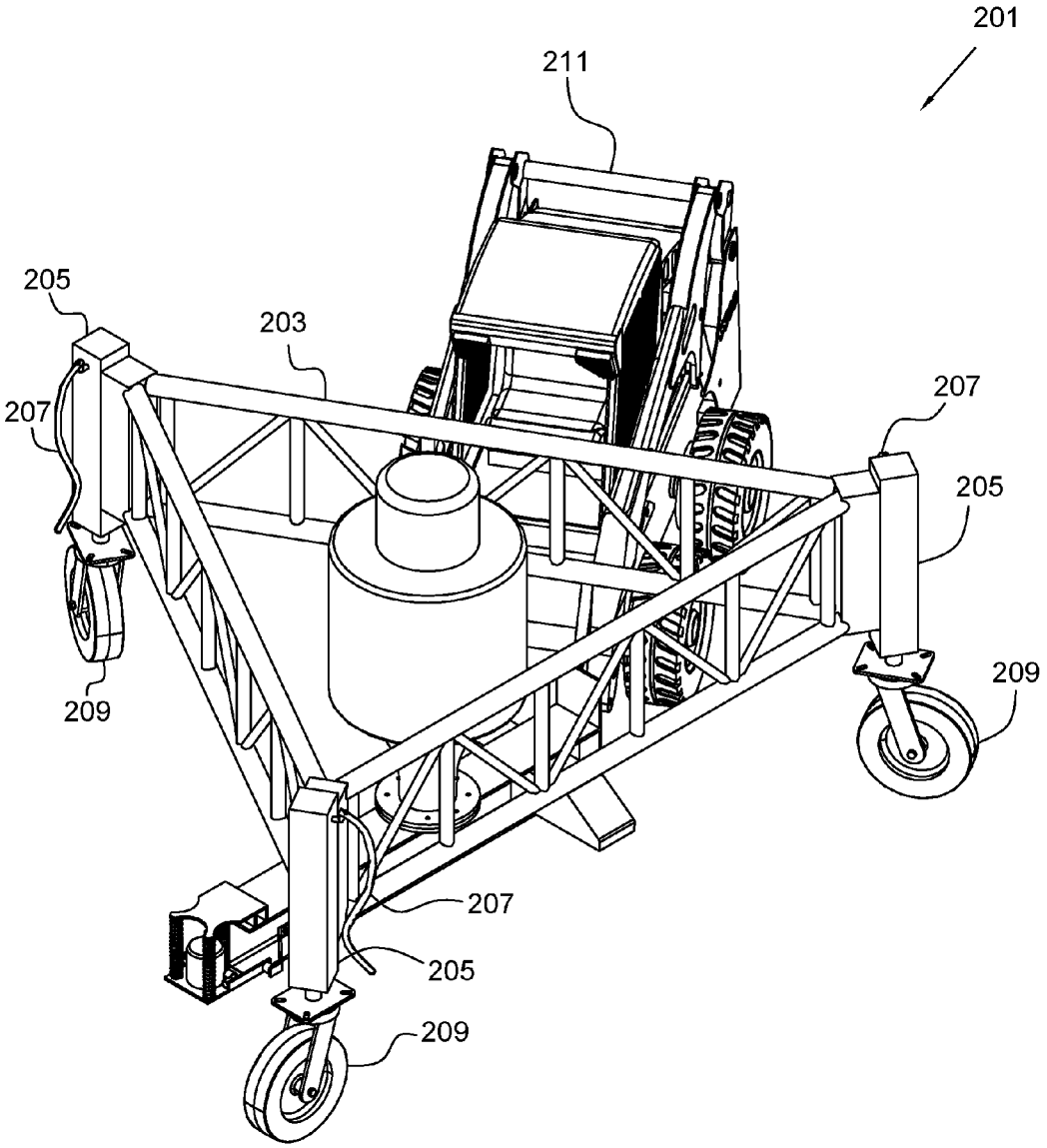
FIG. 2 is an oblique view of a floor processing system in accordance with the preferred embodiment of the present application.

Referring now to the drawings wherein like reference characters identify corresponding or similar elements throughout the several views, FIG. 2 depicts an oblique view of a floor processing system 201 in accordance with a preferred embodiment of the present application. It will be appreciated that system 201 overcomes at least one of the above-listed problems commonly associated with the conventional floor processing systems.

In the contemplated embodiment, system 201 preferably includes a structural frame 203 with one or more adjustable legs 205 with several unique features. As depicted in FIG. 2, the adjustable legs 205 are configured with a crank handle 207 which provides manual, vertical adjustability for leveling. The adjustable legs 205 are also equipped with swiveling caster wheels 209 which are mechanically attached to adjustable legs 205. The swiveling caster wheels 209 provide a means of portability to system 201. Preferably, system 201 is maneuvered during operation by skid steer loader 211 by means of pushing/pulling using straps. In the contemplated embodiment, the system 201 is maneuvered via straps; however, it is also contemplated using different types of maneuvering devices in lieu of straps in alternative embodiments.

Figure 3:
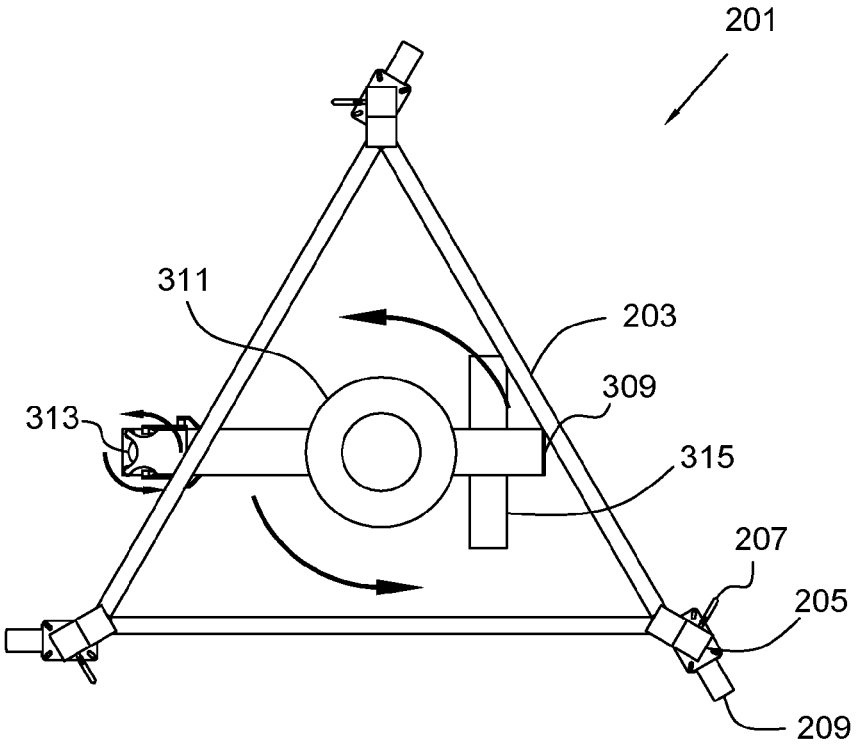
FIG. 3 is a top view of a floor processing system of FIG. 2.
Figure 4:
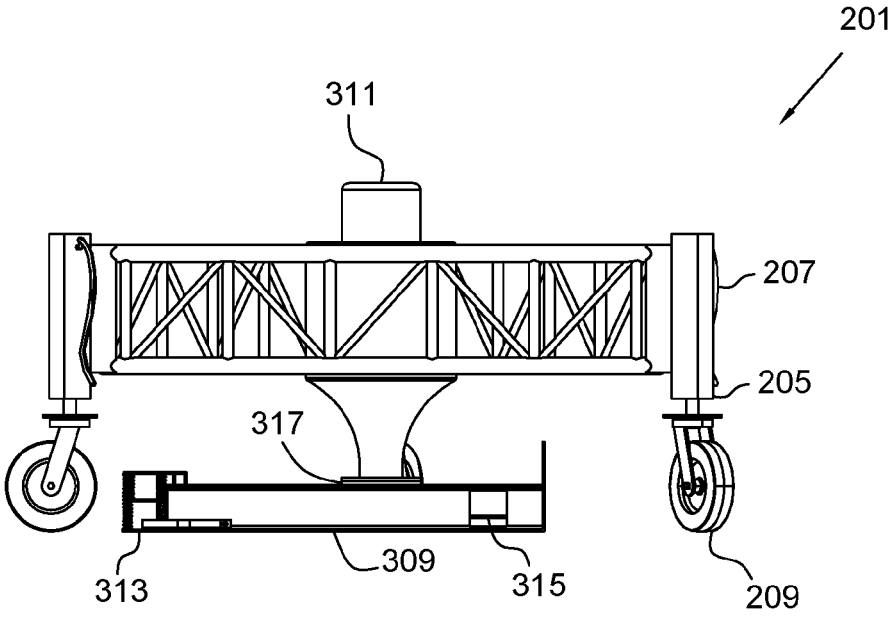
FIG. 4 is a front view of a floor processing system of FIG. 2.

In FIGS. 3 & 4, the moving components of system 201 are shown. In FIG. 3, system 201 includes a rotating beam 309 which is fixably attached to the main drive motor 311. The rotating beam 309 is a structural member which is configured to mount the grinding wheel assembly 313 through mounting flange 317. One or more counter balances 315 are fixably attached to rotating beam 309 on the opposing side of the grinding wheel assembly 313. The counter balances 315 exist to provide an opposing weight on the rotating beam to balance the load during operation.

As depicted in FIG. 3, the rotating beam 309 is moved rotationally by the main drive motor 311 while the grinding wheel assembly 313 contains a rotation about its own centerline. This offset distance between the two rotational centerlines provides for a large sweeping motion of the grinding wheel assembly 313 during operation. Effectively, large area floor processing can be achieved by this sweeping motion of the grinding wheel assembly 313; especially during the maneuvering of system 201 by skid steer loader 211. It is appreciated that this feature overcomes at least on of the above-listed problems commonly associated with the conventional floor processing systems.

Figure 5:
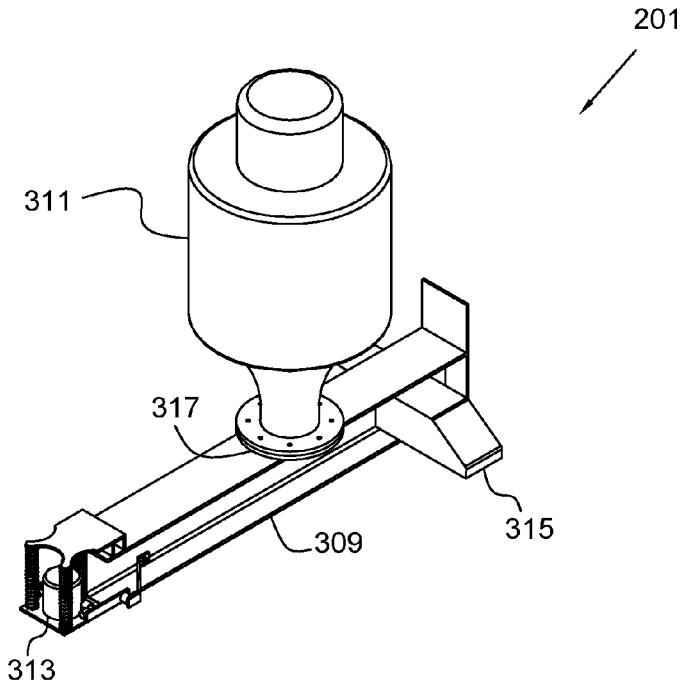
FIG. 5 is a partial oblique view of a floor processing system of FIG. 2.

A partial view of system 201 is given in FIG. 5 to depict the moving components of a preferred embodiment. The grinding wheel assembly 313 pivotably attaches to one end of the rotating beam 309. The pivoting attachment, which will be described in detail below, provides for positional compliance of the grinding wheel assembly since the work surface; e.g. the floor, is typically uneven. The grinding wheel assembly 313 also includes a spring and damper assembly to absorb reaction forces during system operation. Since the grinding wheel assembly is rotated by the rotating beam 309 about the main drive motor 311's center, system 201 is capable of processing, e.g. grinding, flattening, and polishing, in the axial and radial directions simultaneously.

Figure 6A:
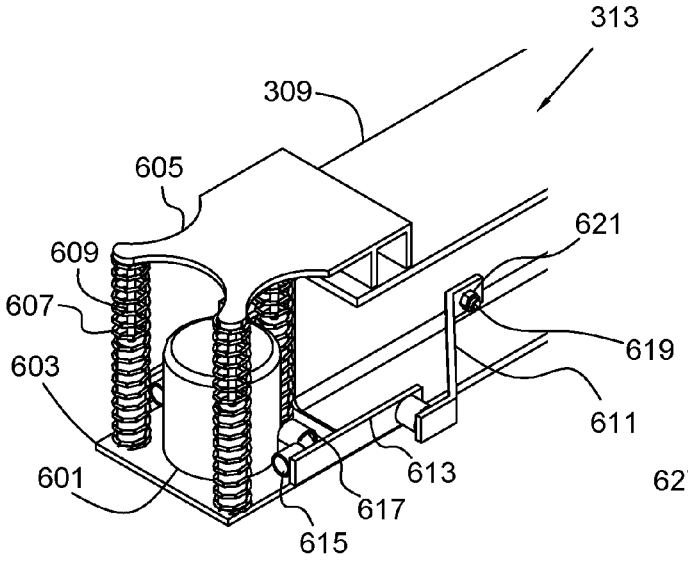
FIG. 6A is a partial oblique view of a floor processing system of FIG. 5.

Referring now to FIG. 6A, the grinding wheel assembly 313 preferably includes a grinder drive motor 601 which fixably attaches to lower plate 603. The lower plate 603 is pivotably attached to rotating beam 309 through one or more pivot blocks 617, pivot pins 615, primary pivot link 613, and secondary pivot links 611. The secondary pivot links 611 are mechanically attached to rotating beam 309 through threaded stud 619 and one or more nuts 621. An upper plate 605 is fixably attached to rotating beam 309. The grinding wheel assembly 313 preferably includes one or more springs 607 and dampers 609 which attach to upper plate 605 and lower plate 603.

Figure 6B:
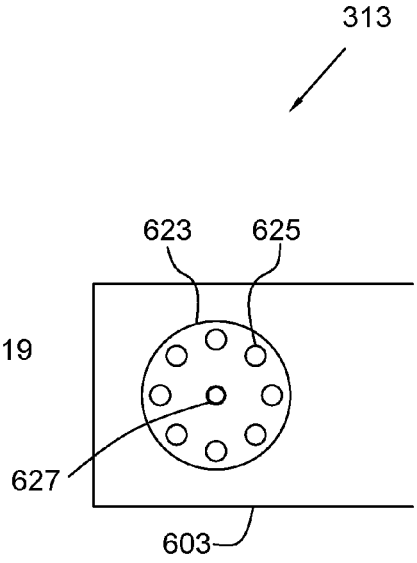
FIG. 6B is a partial bottom view of a floor processing system of FIG. 5.

FIG. 6B depicts a bottom view of grinding wheel assembly 313. In FIG. 6B, grinding wheel assembly 313 includes a grinding wheel 623 which fixably attaches to the grinder drive motor 601. One or more grinding pads 625 are attached to the grinding wheel 623 in a radial array. The grinding wheel 623 is configured such that it can be removed from the grinder drive motor shaft 627 for replacement. It is appreciated that the grinding pads 625 can be configured on grinding wheel 623 in numerous arrangements.

Figure 7:
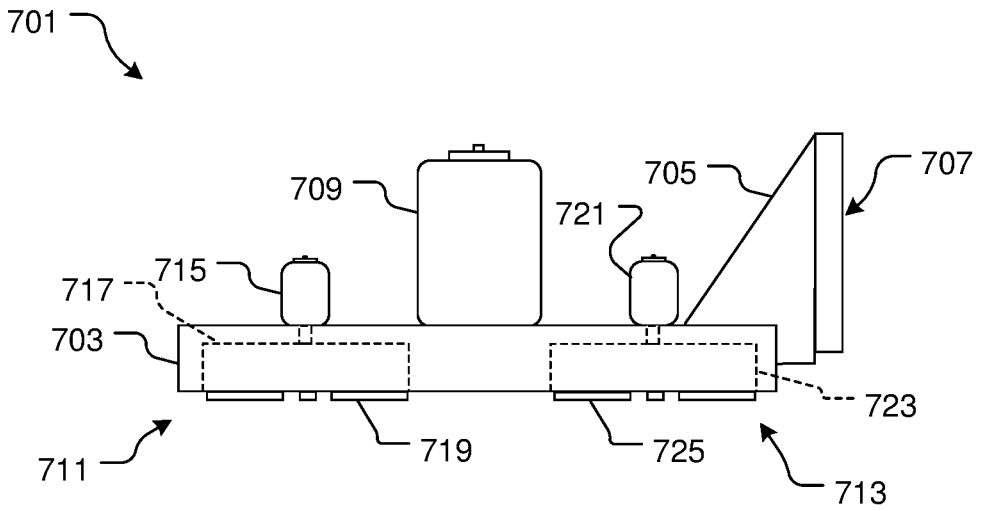
FIG. 7 is a side view of a system in accordance with an alternative embodiment of the present application.
Figure 8:
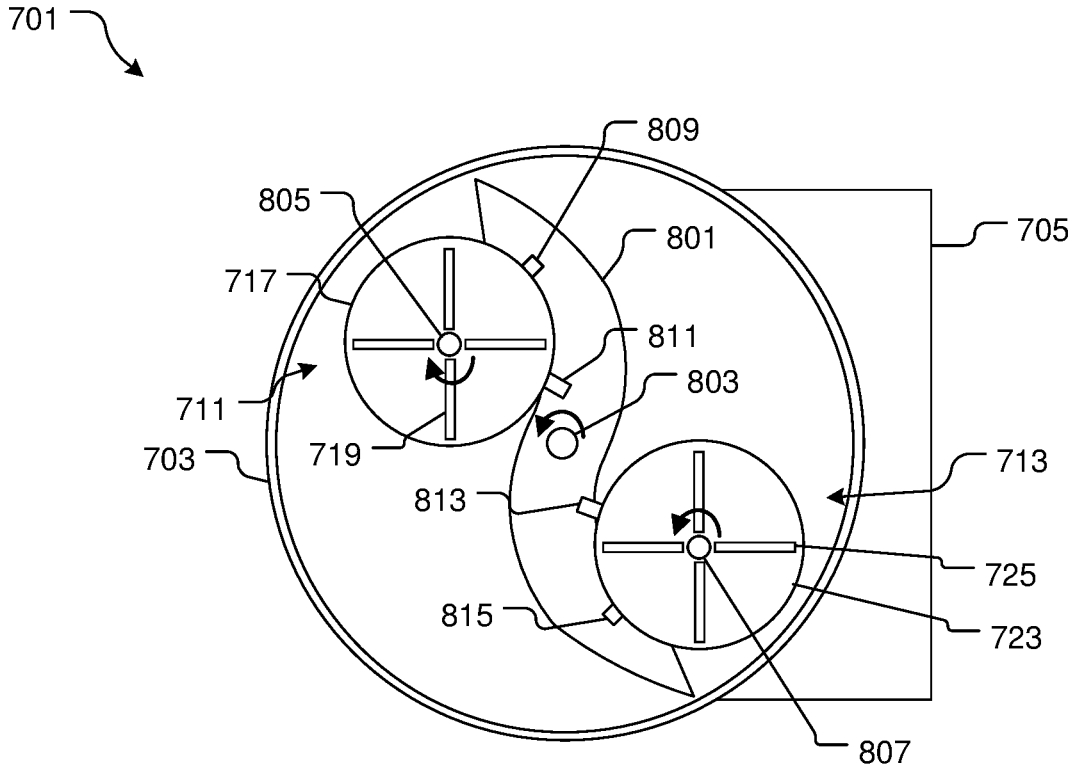
FIG. 8 is a bottom view of the system of FIG. 7.

Referring now to FIGS. 7 and 8, respective front and bottom views of a floor processing system 701 is shown. It will be appreciated that system 701 incorporates one or more of the features of system 201 discussed above.

In the contemplated embodiment, system 701 includes a shroud 703 rigidly attached to a skid steer loader attachment device 705 having a vertical surface 707 adapted to removably engage with the skid steer loader. During use, the system 701 is moved and manipulated by the loader 211. The shroud 703 has a body that engages with a central motor 709 that engages with a rotating arm 801 via a shaft 803. During operation, the arm 801 is configured to rotate planetary rotary assemblies 711, 713 in a circular rotation.

The first rotary assembly 711 includes a motor 715 that engage with a disc 717 via a shaft 805. A plurality of cutters 719 extend from the disc 717 and are adapted to cut the surface being placed thereon. Likewise, assembly 713 includes a motor 721 rotatably attached to a disc 723 via a shaft 807 and a plurality of cutters 725 extending therefrom.

In the contemplated embodiment, a plurality of dampers and/or links 809, 811, 813, and 815 are utilized to secure the rotary assemblies 711, 713 to the arm 801. In one embodiment, the links are secured to the shafts of each assembly.

During operation, the arm 801 rotates, which in turn rotates the assemblies 711, 713. In addition, the assemblies rotate independently of each other and are also contemplated rotating in different rotational directions relative to each other.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A floor processing system for a skid steer loader, comprising:

a shroud having an attachment device configured to removably engage with the skid steer loader;

a central motor secured to the shroud and rotatably attached to an arm;

a first rotary assembly secured to the arm and having:

a first disc rotatably attached to a first motor via a first shaft; and a plurality of first cutters extending from the first disc; and a second rotary assembly secured to the arm and having:

a second disc rotatably attached to a second motor via a second shaft; and a plurality of second cutters extending from the second disc;

wherein the central motor rotates the arm, which in turn rotates the first rotary assembly and the second rotary assembly;

wherein the first rotary assembly simultaneously rotates the first disc; and wherein the second rotary assembly simultaneously rotates the second disc.

* * * * *